US005662496A

United States Patent [19]

Kanamori

[11] Patent Number: 5,662,496

[45] Date of Patent: Sep. 2, 1997

[54] FUSE JUNCTION BOX

[75] Inventor: Hiryasu Kanamori, Shizuoka, Japan

[73] Assignee: Yazaki Corporation, Tokyo, Japan

[21] Appl. No.: 484,300

[22] Filed: Jun. 7, 1995

[51] Int. Cl.[6] ..... H01R 13/68

[52] U.S. Cl. ..... 439/621; 337/186

[58] Field of Search ..... 439/621, 622; 337/186, 187, 201, 208

[56] References Cited

U.S. PATENT DOCUMENTS

| | | | |
|---|---|---|---|
| 3,341,745 | 9/1967 | Munro | 361/630 |
| 4,221,455 | 9/1980 | Cairns | 439/355 |
| 4,238,140 | 12/1980 | Cairns et al. | 439/621 |
| 4,371,743 | 2/1983 | Decker | 439/131 |
| 4,687,270 | 8/1987 | Plyler et al. | 439/350 |
| 4,836,802 | 6/1989 | Phillips | 439/622 |
| 4,941,851 | 7/1990 | Hsueh | 439/621 |
| 5,038,050 | 8/1991 | Minoura | 439/621 |
| 5,088,940 | 2/1992 | Saito | 439/621 |
| 5,145,414 | 9/1992 | Oikawa | 439/621 |
| 5,179,503 | 1/1993 | Fouts et al. . | |
| 5,267,493 | 12/1993 | Yamagata | 29/278 |
| 5,403,193 | 4/1995 | Ito et al. | 439/34 |
| 5,488,345 | 1/1996 | Seki et al. | 439/621 |

FOREIGN PATENT DOCUMENTS

| | | |
|---|---|---|
| 5-54787 | 2/1993 | Japan . |
| 6-46519 | 3/1994 | Japan . |

*Primary Examiner*—Neil Abrams
*Assistant Examiner*—T. C. Patel
*Attorney, Agent, or Firm*—Young & Basile, P.C.

[57] ABSTRACT

An electrical junction box for use in a vehicle is capable of receiving a plurality of fuses of the type having a body and a pair of blades extending from the body. The junction box includes a body portion with a plurality of parallel slots adapted to receive a fuse blade. A substantially rectangular aperture receives a second fuse blade from one side of the junction box and an electrical connector from the other side. A plurality of resilient locking arms extend from the body portion and are arranged such that pairs of locking arms are located on opposite sides of the lateral opening of the aperture and define fuse mounting locations. Each locking arm has an inner surface from which a pair of parallel guide rails extend to form a fuse receiving channel, and a lock projection extends form the inner surface between the guide rails to secure the fuse within the junction box. A fuse puller is used to remove fuses form their positions between the locking arms.

6 Claims, 3 Drawing Sheets

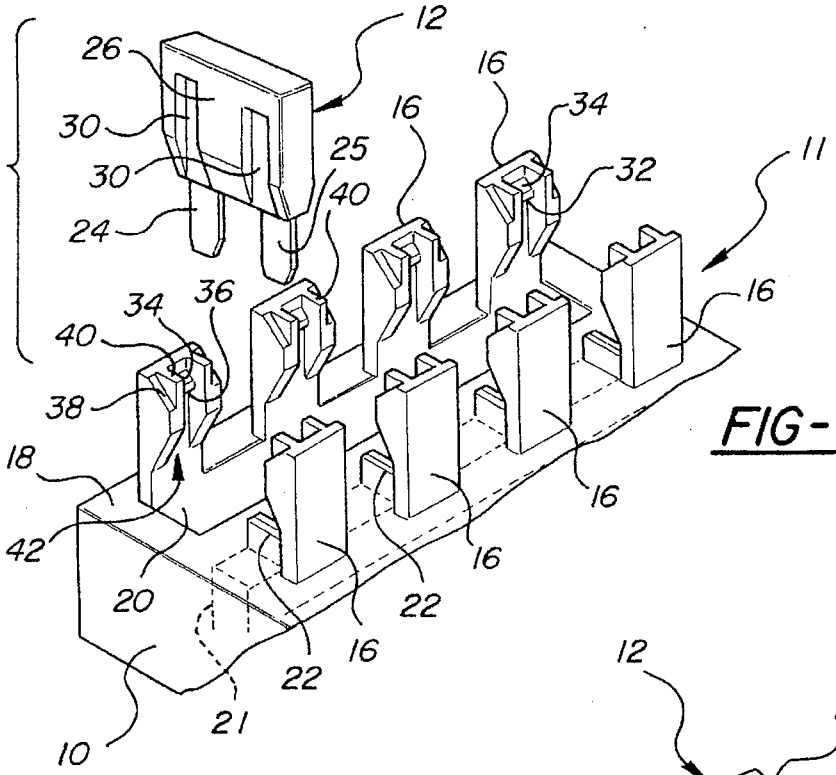
FIG-1
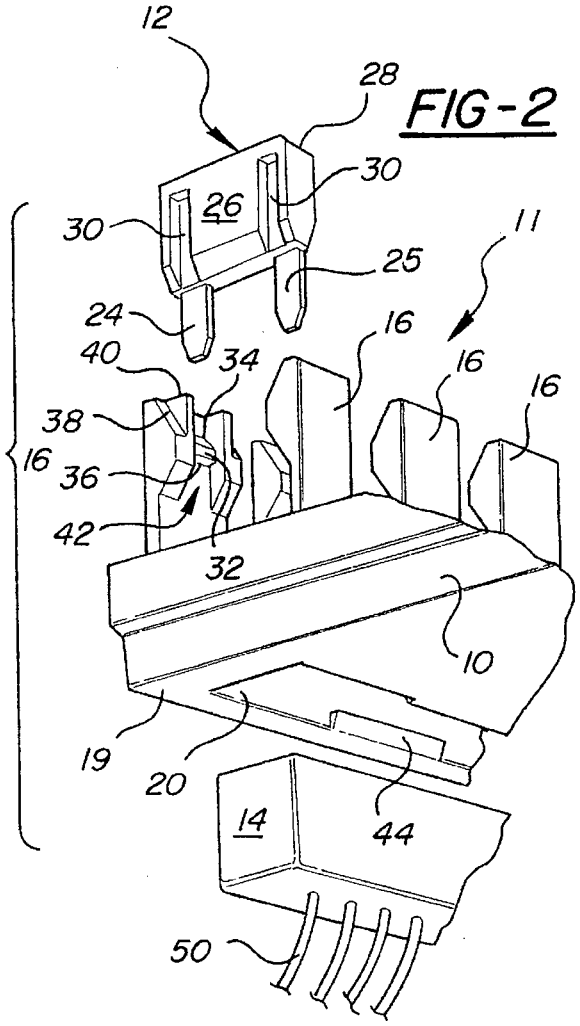
FIG-2
FIG-3
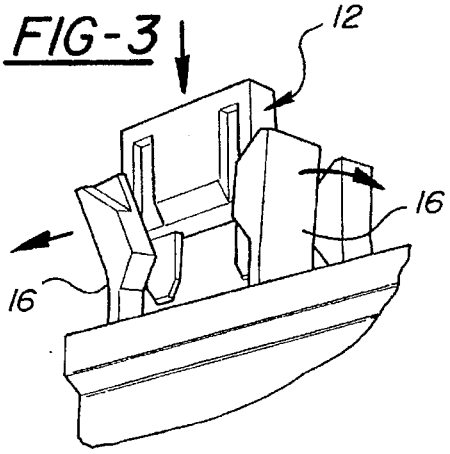

FUSE JUNCTION BOX

FIELD OF THE INVENTION

The present invention relates to a fuse junction box for releasably mounting a plurality of fuses of the type used in a vehicle electrical system.

BACKGROUND OF THE INVENTION

Junction boxes are used in automotive electrical systems to receive fuses which connect a vehicle electrical source with vehicle accessory circuits and provide overcurrent protection for those circuits. Known junction boxes, such as the structure illustrated in FIG. 11, include a junction box 100 which contains a busbar 102. Busbar 102 is connected with the vehicle electrical source and distributes electrical power therefrom to the vehicle electrical circuits through a plurality of wires, one of which is indicated at 108. A terminal 106 is attached to the end of each wire 108, and a fuse 104 provides the connection between busbar 102 and each terminal 106.

In a commonly used assembly procedure, junction box 100 is first assembled to contain busbar 102 and fuses 104, and is subsequently installed in the vehicle, at which time terminals 106, which are part of a wiring harness attached to the vehicle, are inserted into junction box 100 from below to make electrical contact with fuses 104.

As may be seen from FIG. 11, fuse 104 is held within junction box 100 only by the friction between a first fuse blade 110 and busbar terminal 112. As such, when terminal 106 is inserted into junction box 100 to contact a second fuse blade 114, the force of that insertion can overcome the friction between first fuse blade 110 and busbar terminal 112 and cause fuse 104 to become disconnected from terminal 106 or even be completely ejected from the junction box. Since the junction box is generally installed in the vehicle in an assembly line environment, this is a particularly undesirable time to have fuses ejected from the junction box.

Furthermore, handling and shipment of junction box 100 prior to installation in the vehicle can loosen the frictional engagement between blade 110 and terminal 112, thereby causing fuse 104 to be unintentionally released from junction box 100.

Therefore, the failure of these known junction boxes to provide any mechanism to secure the fuses within the junction box is a distinct disadvantage.

SUMMARY OF THE INVENTION

The present invention provides an electrical junction box capable of receiving and releasably securing a plurality of fuses of the type having a body and a pair of prongs or blades extending from the body.

The junction box contains a series of terminal pairs and the fuses are inserted into the box to establish respective electrical connection between the terminals of each pair. The junction box has a plurality of pairs of arms extending from the junction box surface, with each arm pair bracketing a terminal pair and including latching means which engage the fuse body to secure the fuse in connection with its terminal pair.

In the illustrative embodiment, the junction box includes a body portion with a plurality of parallel slots extending into the body and adapted to receive the first blade of each of the fuses so that the blades thereof contact a busbar located within the body, the busbar providing the first terminal of each terminal pair. The junction box body also includes an elongated aperture located alongside the slots and extending through the body. The aperture is adapted to receive the second blade of each of the fuses from a first face of the body, and a connector containing the second terminal of each terminal pair from the opposite second face so that the second fuse blades are in electrical contact with the second terminals.

According to a feature of the invention, a plurality of resilient locking arms extend from the first face of the body and are arranged such that pairs of locking arms bracket the aperture and one of the slots to define fuse mounting locations. Each locking arm has a pair of parallel guide rails extending inwardly therefrom to define a longitudinal channel. A lock projection extends into the channel from the inner surface of each locking arm, each lock projection having an upper cam surface and a lower step surface which act to releasably latch the fuse between the pair of locking arms.

According to another feature of the invention, each locking arm further includes camming means which forces each pair of locking arms away from one another and releases the lock projections from the fuse when a fuse removal tool is inserted between the locking arms. In this manner, a fuse may be easily removed from between the locking arms when necessary, for example to change a burned out fuse. In the preferred embodiment of the invention, the camming means comprises a pair of cam surfaces formed on the inner surface of each locking arm adjacent the guide rails.

According to still another feature of the present invention, the junction box body further includes means for securing the connector within the aperture so that it will not inadvertently become dislodged during shipping of the junction box or during operational use.

BRIEF DESCRIPTION OF THE DRAWINGS

FIG. 1 is an exploded perspective view of the inventive junction box, illustrating the fuse, connector, and resilient locking arms;

FIG. 2 is a bottom perspective view of the junction box, fuse, and connector;

FIG. 3 is a detail view illustrating a fuse partially inserted between a pair of resilient locking arms;

DETAILED DESCRIPTION OF THE PREFERRED EMBODIMENTS

Figure 4:
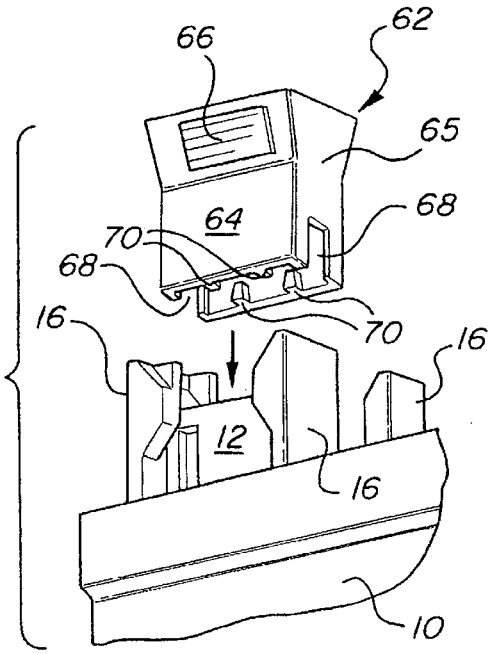
FIG. 4 illustrates a fuse fully inserted into the junction box and a fuse puller positioned above the mounted fuse.
Figure 5:
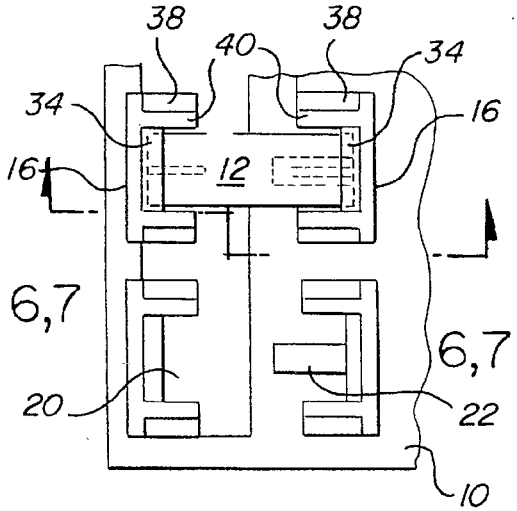
FIG. 5 is a top view of the junction box showing a fuse inserted between one pair of locking arms and an empty socket located between another pair of locking arms.

Referring to FIGS. 1 and 2, a junction box 11 comprises a body portion 10 and a plurality of resilient locking arms 16 arranged in horizontally opposed pairs and extending in a substantially perpendicular manner from a top surface 18 of body portion 10. An elongated aperture 20 extends completely through body portion 10 in a vertical direction as viewed in FIGS. 1 and 2, and a locking pawl 44 projects into aperture 20 adjacent a bottom surface 19 of body portion 10. A plurality of slots 22 are formed in top surface 18 and communicate with an elongated cavity 21 internal to body portion 10. Cavity 21 is adjacent and parallel to aperture 20 and houses a busbar 58, as seen in FIG. 6.

Figure 6:
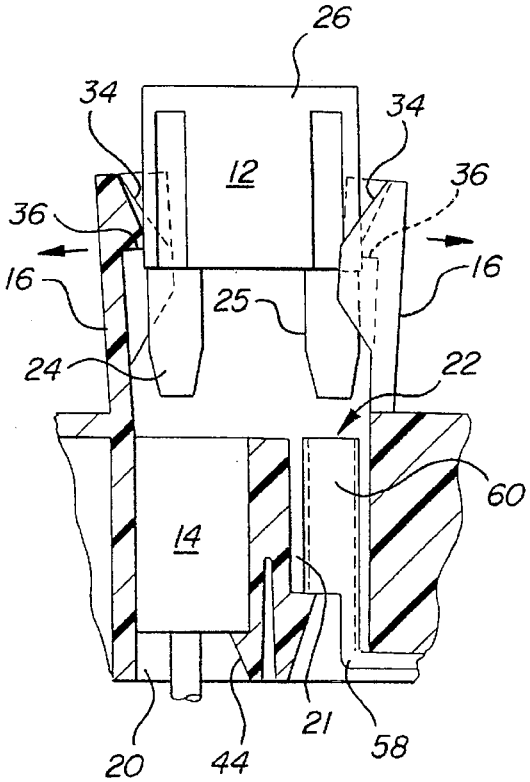
FIG. 6 is a side cross-sectional view of the junction box with a fuse partially inserted between a pair of locking arms and the connector fully inserted into the junction box.

As is best seen in FIG. 6, busbar 58 includes a plurality of busbar terminals 60, each of which is aligned with a slot 22 and provides a first terminal of a series of terminal pairs.

The locking arms 16 which make up each pair are spaced apart from one another to bracket aperture 20 and one of slots 22. Each locking arm 16 has a pair of parallel guide rails 40 extending inwardly to define therebetween a vertically disposed channel 42, and outer cam surfaces 38 are formed immediately adjacent the outer surfaces of rails 40. A lock projection 32 is located between guide rails 40, extending into channel 42, and has a sloping cam surface 34 on its upper side and a step surface 36 on its bottom side.

Referring again to FIGS. 1 and 2, a fuse 12 and a connector 14 are shown in positions immediately prior to engagement with junction box 11 in the manner hereinafter described. Fuse 12 comprises a body 26 and first and second downwardly extending blades, 24 and 25 respectively. Two channels 30 are formed in each side of fuse body 26, extending vertically from the bottom of the fuse body to just short of the top.

Figure 7:
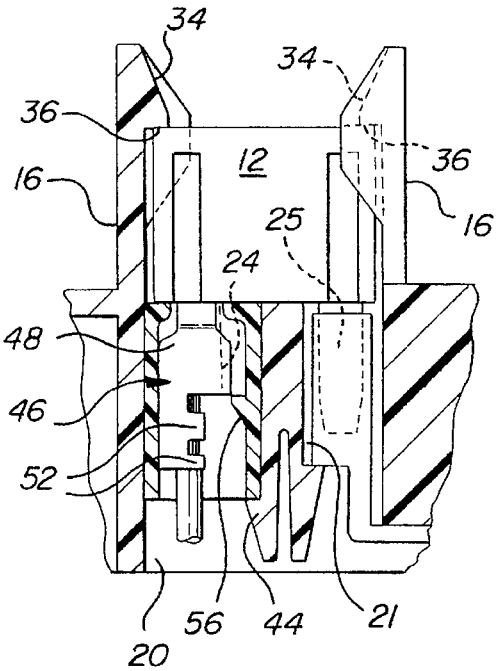
FIG. 7 is a side cross-sectional view of the junction box with a fuse fully inserted between a pair of locking arms and the connector fully inserted into the junction box.

Referring to FIG. 7, connector 14 encloses a plurality of connector terminals 46 which are in electrical contact with wires 50, the connector and attached wires constituting a portion of the vehicle wiring harness. Only one connector terminal 46 is visible in FIG. 7, the remaining terminals being located along the length of connector 14 to align with each of the fuse positions provided by junction box 10 and provide the second terminals of the series of terminals pairs. Each connector terminal 46 includes an electrical contact portion 48 for mating with a fuse 12 and crimp tabs 52 for securing the terminal to a wire 50. A locking tab 56 formed within connector 14 engages connector terminals 46 to secure the terminals within the connector.

Referring now to FIG. 4, a fuse puller 62 is shown to be comprised of a pair of opposite longitudinal side walls 64 and a pair of opposite lateral side walls 65. A pair of notches 68 are formed in side walls 65, and finger grips 66 are provided on the exterior of longitudinal side walls 64. A plurality of protrusions 70 extend inwardly from the inner surface of the longitudinal side walls 64. In the preferred embodiment, there are four protrusions 70, two on each of the longitudinal side walls 64 to match the channels 30 of fuse 12.

INDUSTRIAL APPLICATION

Typically, junction box 11 is assembled to include busbar 58 and its full complement of fuses 12 in a first assembly procedure performed at a facility remote from the final vehicle assembly location. To insert fuses into junction box 11, a fuse 12 is positioned above a vacant fuse mounting location, as shown in FIGS. 1 and 2. Fuse 12 is then moved downward toward the pair of resilient locking arms 16 until fuse body 26 contacts lock projections 32 extending inwardly from locking arms 16. Since the distance between lock projections 32 is less than the width of fuse body 26, the fuse body contacts cam surfaces 34 of lock projection 32. As seen in FIGS. 3 and 6, as fuse 12 is urged downwardly between locking arms 16, the interface between fuse body 26 and cam surfaces 34 causes resilient locking arms 16 to flex outwardly. As the locking arms flex outwardly, fuse 12 moves downward to pass between lock projections 32, and second fuse blade 25 comes into frictional engagement with a busbar terminal 60 of busbar 58. As shown in FIG. 7, when fuse 12 is fully inserted between locking arms 16, the locking arms return to their original position, thereby securely latching the fuse within the junction box and in electrical contact with busbar terminal 60 due to the engagement between the top surface of fuse 12 and step surface 36 of lock projections 32.

At this point, the junction box assembly, including inserted fuses 12, is shipped to a final assembly location for installation in the vehicle during the final vehicle assembly procedure. Since resilient locking arms 16 secure fuses 12 within the junction box, the fuses are not loosened from busbar terminals 60 nor dislodged from the junction box during shipping and handling.

During the final assembly procedure, busbar 58 is connected with the vehicle electric power supply and connector 14, part of the vehicle wiring harness, is inserted into aperture 20 from the bottom of junction box 11 to bring first fuse blades 24 into engagement and electrical contact with connector terminals 46. Locking pawl 44 deflects as connector 14 is inserted into aperture 20 and snaps back to hook underneath connector 14 when the connector is fully inserted as seen in FIG. 7. Again, since fuses 12 are latched securely within the junction box, any physical interference between fuse blade 24 and terminals 46 during insertion of connector 14 will not loosen or eject the fuses from the junction box. Thus, all fuses 12 as well as connector 14 are securely positioned within the junction box, and will not be disconnected or ejected due to vibrations and movements of the vehicle.

Figure 8:
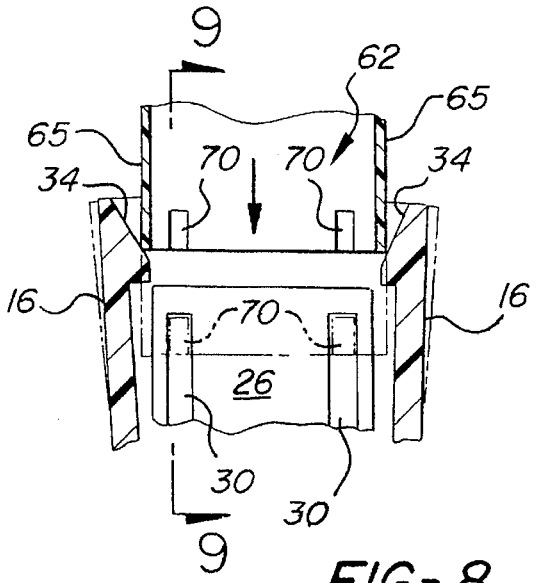
FIG. 8 is a side cross-sectional view illustrating the deflection of the resilient locking arms as the fuse puller is inserted over the fuse.
Figure 9:
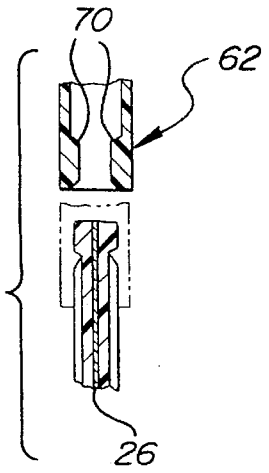
FIG. 9 is an end view of the illustration shown in FIG. 8.
Figure 10:
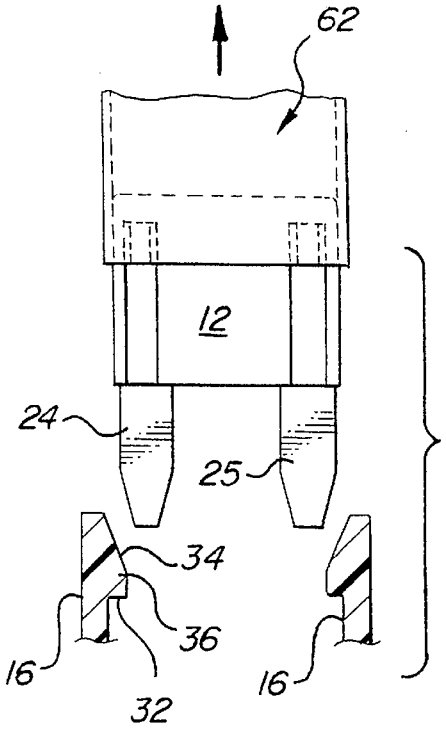
FIG. 10 illustrates the position of the fuse puller with respect to the fuse upon removal of the fuse from the locking arms.
Figure 11:
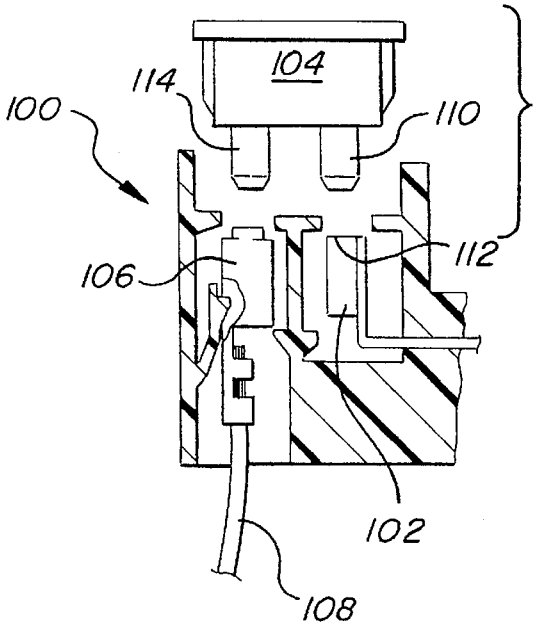
FIG-11 PRIOR ART
FIG. 11 illustrates a prior art junction block with associated fuse and electrical terminal.

During the operational life of the vehicle, it may be necessary to remove or replace certain fuses which have "burned out" or to perform other maintenance or diagnostic procedures requiring fuse removal. To remove fuse 12 from junction box 11, fuse puller 62 is positioned over the fuse as shown in FIG. 4. As shown in FIG. 8, when fuse puller 62 is urged downwardly toward fuse 12, the lateral sides 65 of the fuse puller contact outer cam surfaces 38 of locking arms 16, thereby forcing the locking arms to flex outwardly. As fuse puller 62 is urged further downward toward fuse 12, protrusions 70 on the inner side walls of the fuse puller contact the top of the fuse, and the longitudinal side walls 64 of the fuse puller are initially deflected outwardly. As fuse puller 62 passes over the top of fuse 12, protrusions 70 snap into channels 30 in the body of fuse 12, allowing the walls of the fuse puller to return to their original shape. At this point, resilient locking arms 16 are maintained in the flexed position, thereby releasing lock projection 32 from fuse 12. By pulling upwardly on fuse puller 62, fuse 12 may be removed from the junction box. After fuse 12 has been extracted from the junction box, it is removed from fuse puller 64 by inverting the fuse puller and allowing the fuse to slide out the open top end of the fuse puller. Thus, fuse puller 62 provides a convenient method of removing fuses from the junction box without the need for any additional tools.

It will be appreciated that the drawings and descriptions contained herein are merely meant to illustrate a particular embodiment of the present invention and are not meant to be limitations upon the practice thereof, as numerous variations will occur to persons of skill in the art.

I claim:

1. A junction box for use in establishing respective electrical connection between a series of terminal pairs positioned within the junction box utilizing a series of fuses with each fuse including a body and a pair of blades insertable into the junction box from a surface thereof to establish electrical connection between the terminals of the respective terminal pairs, the junction box including a plurality of pairs of locking arms extending from the junction box surface with each locking arm pair positioned in bracketing relation to the respective terminal pair, each locking arm of at least one pair having an inner side, a pair of parallel guide rails extending from the inner side to define therebetween a longitudinal channel for receiving the fuse, and a lock projection extending from the inner side into the channel for releasably securing the fuse within the channel, each of the guide rails having an inner surface facing the channel and an outer surface facing away from the channel, a pair of cam surfaces being formed on said outer surfaces of the guide rails.

2. A junction box according to claim 1 wherein each of the locking projections of at least one of the locking arm pairs comprises an upper cam surface and a lower step surface, the lower step surfaces engaging the body of the fuse to prevent removal of the fuse from the inserted position unless the arms of the at least one pair are forced away from one another as the fuse is urged away from the inserted position.

3. An electrical junction box for receiving a plurality of fuses and an electrical connector, the fuses having a body with a first and a second blade extending therefrom, and the electrical connector containing a plurality of terminals each adapted to make electrical contact with the first blade of one of the fuses, the junction box comprising:

a body portion having opposite first and second surfaces and including (a) an aperture extending through the body between the first and second surfaces and adapted to receive the connector from the second surface, (b) a plurality of slots formed in the first surface of the body portion each adapted to receive the second blade of one of the fuses, and (c) a conductive busbar housed within the body portion and having a plurality of electrical contacts each in communication with one of the slots and adapted to make electrical contact with the second blade of one of the fuses when the second blade is inserted into the respective slot; and a plurality of resilient locking arms extending from the first surface of the body portion and arranged in pairs, each pair bracketing the aperture and one of the slots, each locking arm having an inner side and comprising:

a pair of parallel guide rails extending perpendicularly from the inner side of the locking arm and defining a longitudinal channel therebetween to receive one of the fuses, each of said guide rails having an inner surface facing said longitudinal channel for guiding one of the fuses and an opposite outer surface facing away from said channel;

a lock projection extending into the channel from the inner side of the locking arm for releasably securing the fuse within the channel; and a pair of cam surfaces formed on the outer surfaces of the guide rails, said cam surfaces serving to force the locking arms of each pair away from one another and release the lock projection from the fuse when a fuse removal tool is inserted between the pair of locking arms.

4. An electrical junction box according to claim 3 wherein the lock projection has an upper cam surface and a lower step surface, the lower step surfaces engaging the body of the fuse to prevent removal of the fuse from the channel unless the locking arms are forced away from one another as the fuse is urged out of the channel.

5. The apparatus of claim 3 further including means for securing the connector within the aperture.

6. The apparatus of claim 5 wherein said means for securing the connector within said aperture comprises a locking pawl extending from said body portion into said aperture.

* * * * *